US007909107B2

(12) United States Patent
Gette

(10) Patent No.: US 7,909,107 B2
(45) Date of Patent: Mar. 22, 2011

(54) HIGH CAPACITY RUNNING TOOL AND METHOD OF SETTING A PACKOFF SEAL

(75) Inventor: Nicholas P. Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 168 days.

(21) Appl. No.: 12/416,780

(22) Filed: Apr. 1, 2009

(65) Prior Publication Data

US 2010/0252277 A1 Oct. 7, 2010

(51) Int. Cl.

| | |
|---|---|
| ***E21B 23/00*** | (2006.01) |
| ***E21B 43/10*** | (2006.01) |
| ***E21B 33/12*** | (2006.01) |
| ***E21B 21/00*** | (2006.01) |
| ***E21B 23/08*** | (2006.01) |

(52) U.S. Cl. ..... 166/382; 166/208; 166/182; 166/212; 166/383

(58) Field of Classification Search ..... 166/116, 166/182, 187, 208, 212, 179, 383
See application file for complete search history.

(56) References Cited

U.S. PATENT DOCUMENTS

| | | | | | |
|---|---|---|---|---|---|
| 4,060,131 | A | * | 11/1977 | Kenneday et al. | 166/382 |
| 4,096,913 | A | * | 6/1978 | Kenneday et al. | 166/290 |
| 4,641,708 | A | * | 2/1987 | Wightman | 166/208 |
| 4,712,621 | A | * | 12/1987 | Wightman et al. | 166/382 |
| 4,969,516 | A | | 11/1990 | Henderson et al. | |
| 5,417,288 | A | * | 5/1995 | Melenyzer et al. | 166/382 |
| 6,966,370 | B2 | * | 11/2005 | Cook et al. | 166/212 |
| 7,231,970 | B2 | | 6/2007 | Matusek et al. | |

* cited by examiner

*Primary Examiner* — David J Bagnell
*Assistant Examiner* — Sonya Bible
(74) *Attorney, Agent, or Firm* — Bracewell & Giuliani

(57) ABSTRACT

A high capacity running tool sets and internally tests a casing hanger packoff during the same trip. The running tool has a stem and a body. The body is secured by threads to the stem of the running tool so that rotation of the stem relative to the body will cause the stem to move longitudinally. An engagement element connects the tool body to the casing hanger by engaging the inner surface of the casing hanger. Longitudinal movement of the stem relative to the body moves the engaging element between inner and outer positions and lines up ports in the stem and in the body for setting and testing functions.

20 Claims, 5 Drawing Sheets

HIGH CAPACITY RUNNING TOOL AND METHOD OF SETTING A PACKOFF SEAL

FIELD OF THE INVENTION

This invention relates in general to tools for running casing hangers in subsea wells, and in particular to a high capacity tool that sets and internally tests a casing hanger packoff in one trip.

BACKGROUND OF THE INVENTION

A subsea well of the type concerned herein will have a wellhead supported on the subsea floor. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. Afterward, a packoff is positioned between the wellhead bore and an upper portion of the casing hanger. This seals the casing hanger annulus.

Casing hanger running tools perform many functions such as running and landing casing strings, cementing strings into place, and installing and testing packoffs. Testing the packoff is traditionally performed by pressuring under the blow out preventer (BOP) stack, but more recent casing hanger running tool designs incorporate an "internal" or "down the drill pipe" test which isolates the test pressure to a small volume just above the hanger. An internal test has several benefits including reducing the annular pressure end load reacted against the hanger and making leak detection more direct, which is especially beneficial for sub-mudline casing strings which can be located several thousand feet from the BOP stack. The cost of the added functionality is complexity in the form of additional ports and seals.

Virtually all casing hanger running tools to date incorporate a cam that acts as a mechanical program for the tool. Rotational inputs to the cam drive it axially, causing it to drive engaging elements such as dogs radially, allows seal-setting pistons to communicate with the stem, and opens up additional ports for internal testing. Typically, cams occupy the radial space between the stem and the body of the running tool and must be thick enough to withstand radial loads generated by the dogs and pressure loads from setting and testing packoffs. If the cam could be eliminated, the radial space it normally occupied could be used to thicken up the body and the stem, thus increasing the hanging capacity of the tool. A need exists for a technique that addresses increased hanging capacity of a running tool, coupled with the ability to internally test a packoff. The following technique may solve one or more of these problems.

SUMMARY OF THE INVENTION

In an embodiment of the present technique, a high capacity running tool sets and internally tests a casing hanger packoff during the same trip. The running tool is comprised of a body and a stem. The body is secured by threads to the stem of the running tool so that rotation of the stem relative to the body will cause the stem to move longitudinally. An engagement element connects the tool body to the casing hanger by engaging an inner surface of the casing hanger. Longitudinal movement of the stem relative to the body moves the engaging element between an inner and outer position, thereby securely engaging the running tool and the casing hanger. Longitudinal movement of the stem relative to the body also lines up ports in the stem and the body for setting and testing functions, much like a cam in previous running tools.

DETAILED DESCRIPTION OF THE INVENTION

Figure 1:
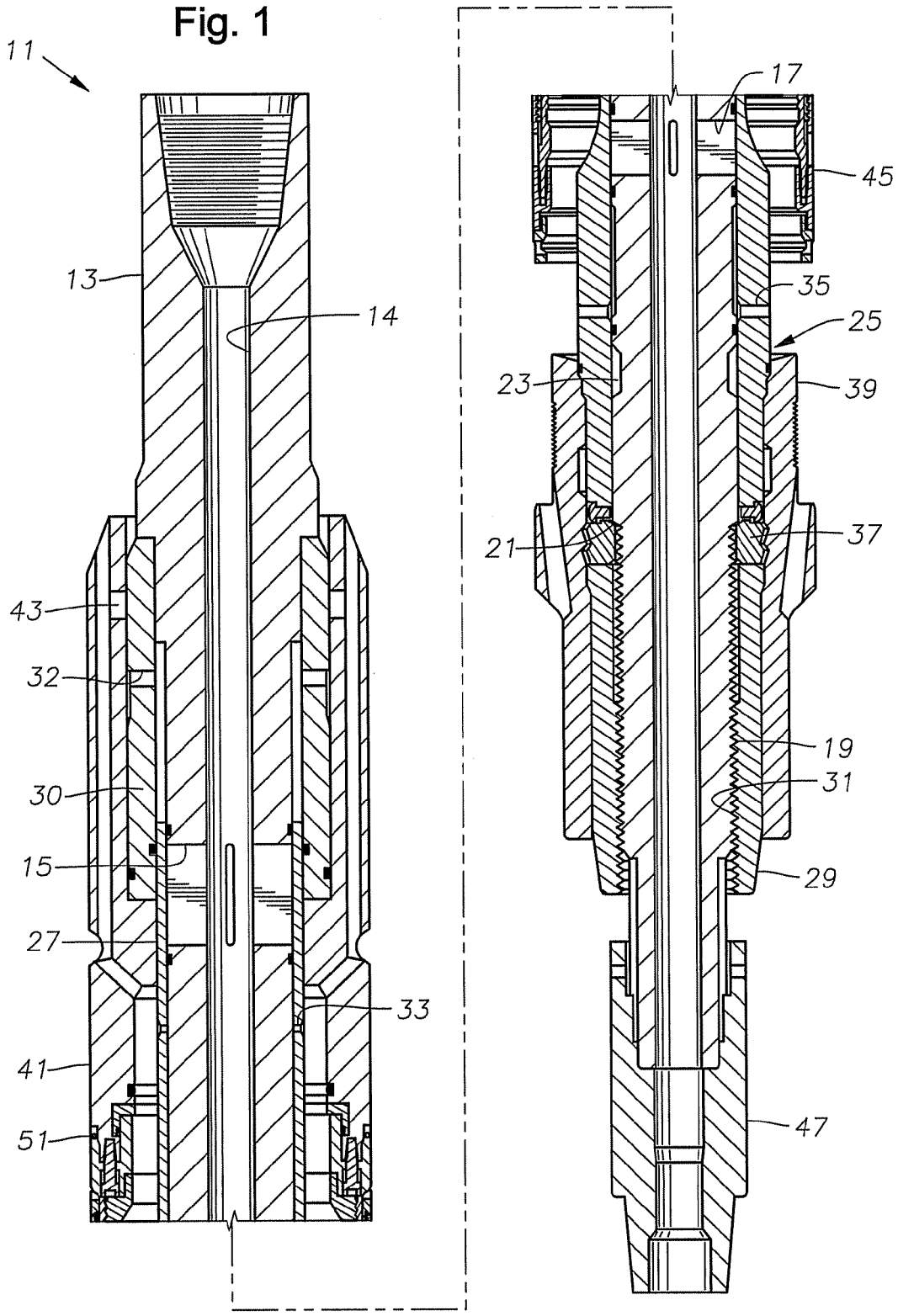
FIG. 1 is a sectional view of a high capacity running tool constructed in accordance with the present technique with the piston cocked and the engagement element retracted.

Referring to FIG. 1, there is generally shown an embodiment for a high capacity running tool 11 that is used to set and internally test a casing hanger packoff. The high capacity running tool 11 is comprised of a stem 13. Stem 13 is a tubular member with an axial passage 14 extending therethrough. Stem 13 connects on its upper end to a string of drill pipe (not shown). Stem 13 has an upper stem port 15 and a lower stem port 17 positioned in and extending therethrough that allow fluid communication between the exterior and axial passage of the stem 13. A lower portion of the stem 13 has threads 19 in its outer surface. The outer diameter of an upper portion of stem 13 is greater than the outer diameter of the lower portion of stem 13 containing threads 19. As such, a downward facing shoulder 21 is positioned adjacent threads 19. A recessed pocket 23 is positioned in the outer surface of the stem 13 at a select distance above the downward facing shoulder 21.

Running tool 11 has a body 25 that surrounds stem 13, as stem 13 extends axially through the body 25. Body 25 has an upper body portion 27 and a lower body portion 29. The upper portion 27 of body 25 is a thin sleeve located between an outer sleeve 30 and stem 13. Outer sleeve 30 is rigidly attached to stem 13. A latch device (not shown) is housed in a slot 32 located within the outer sleeve 30. The lower body portion 29 of body 25 has threads 31 along its inner surface that are engaged with threads 19 on the outer surface of stem 13. Body 25 has an upper body port 33 and a lower body port 35 positioned in and extending therethrough that allow fluid communication between the exterior and interior of the stem body 25. The lower portion 29 of body 25 houses an engaging element 37. In this particular embodiment, engaging element 37 is a set of dogs having a smooth inner surface and a contoured outer surface. The contoured outer surface is adapted to engage a complimentary contoured surface on the inner surface of a casing hanger 39 when the engagement element 37 is engaged with the casing hanger 39. Although not shown, a string of casing is attached to the lower end of casing hanger 39. The inner surface of the engaging element 37 is initially in contact with the threads 19 on the inner surface of stem 13.

Figure 3:
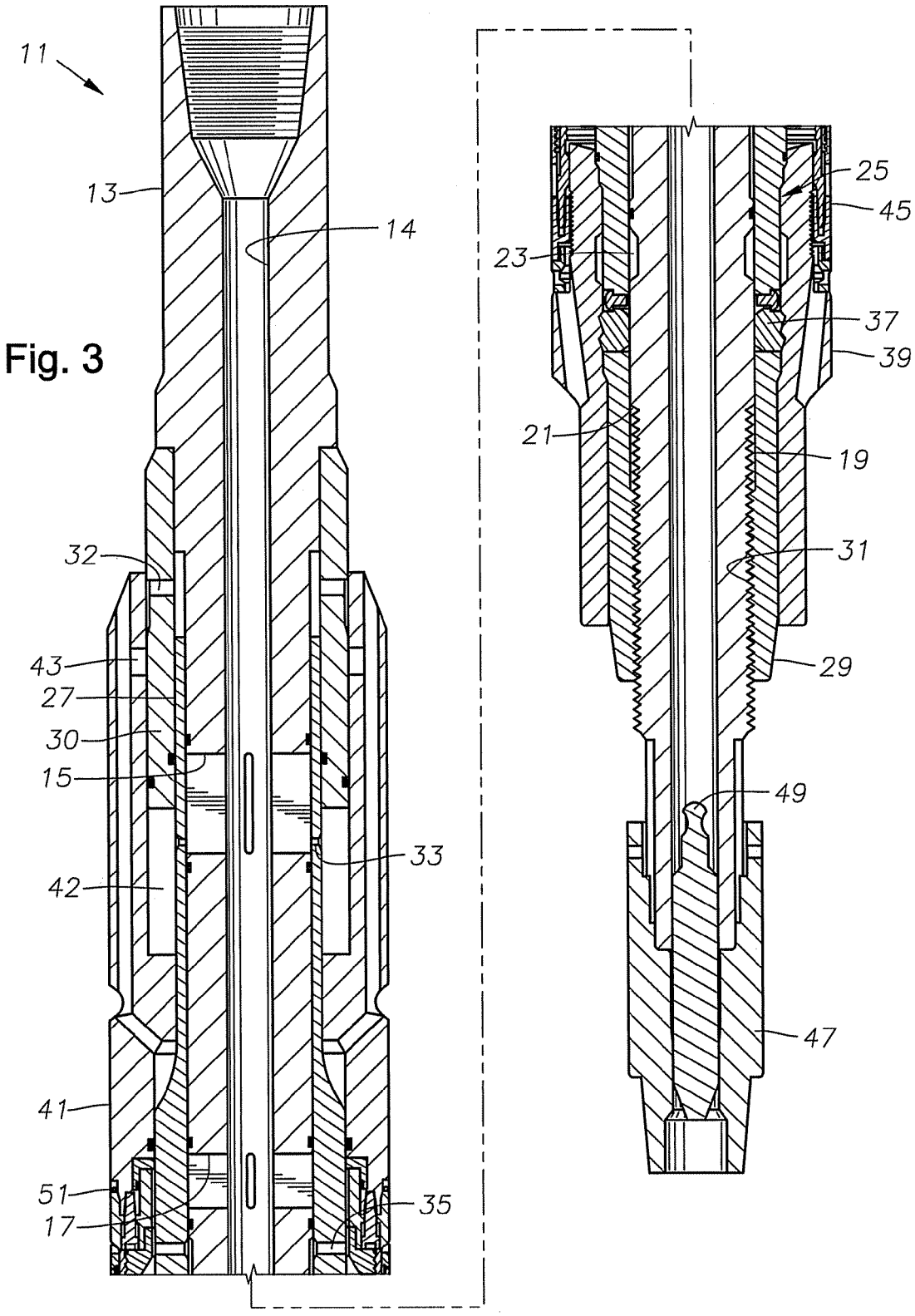
FIG. 3 is a sectional view of the high capacity running tool of FIG. 1 in the setting position.

A piston 41 surrounds the stem 13 and substantial portions of the body 25. Referring to FIG. 3, a piston chamber 42 is formed between upper body portion 27, outer sleeve 30, and piston 41. Piston 41 is initially in a and upper or "cocked" position relative to stem 13, meaning that the area of piston chamber 42 is at its smallest possible value, allowing for piston 41 to be driven downward. A piston locking ring 43 extends around the outer peripheries of the inner surface of the piston 41. Locking ring 43 works in conjunction with the latch device (not shown) contained within outer sleeve slot 32 to restrict movement of the piston during certain running tool functions. A casing hanger packoff seal 45 is carried by the piston 41 and is positioned along the lower end portion of piston 41. Packoff seal 45 will act to seal the casing hanger 39 to the wellbore (not shown) when properly set. While piston 41 is in the upper or "cocked" position, packoff seal 45 is spaced above casing hanger 39.

A dart landing sub 47 is connected to the lower end of stem 13. The landing sub 47 will act as a landing point for an object, such as a dart, that will be lowered into the stem 13. When the object or dart lands within the landing sub 47, it will act as a seal, effectively sealing the lower end of stem 13.

Referring to FIG. 1, in operation, the high capacity running tool 11 is initially positioned such that it extends axially through a casing hanger 39. The piston 41 is in a "cocked" position, and the stem ports 15, 17 and body ports 33, 35 are axially offset from one another. Casing hanger packoff seal 45 is carried by the piston 41. The running tool 11 is lowered into the casing hanger 39 until the outer surface of the body 25 of running tool 11 slidingly engages the inner surface of casing hanger 39.

Figure 2:
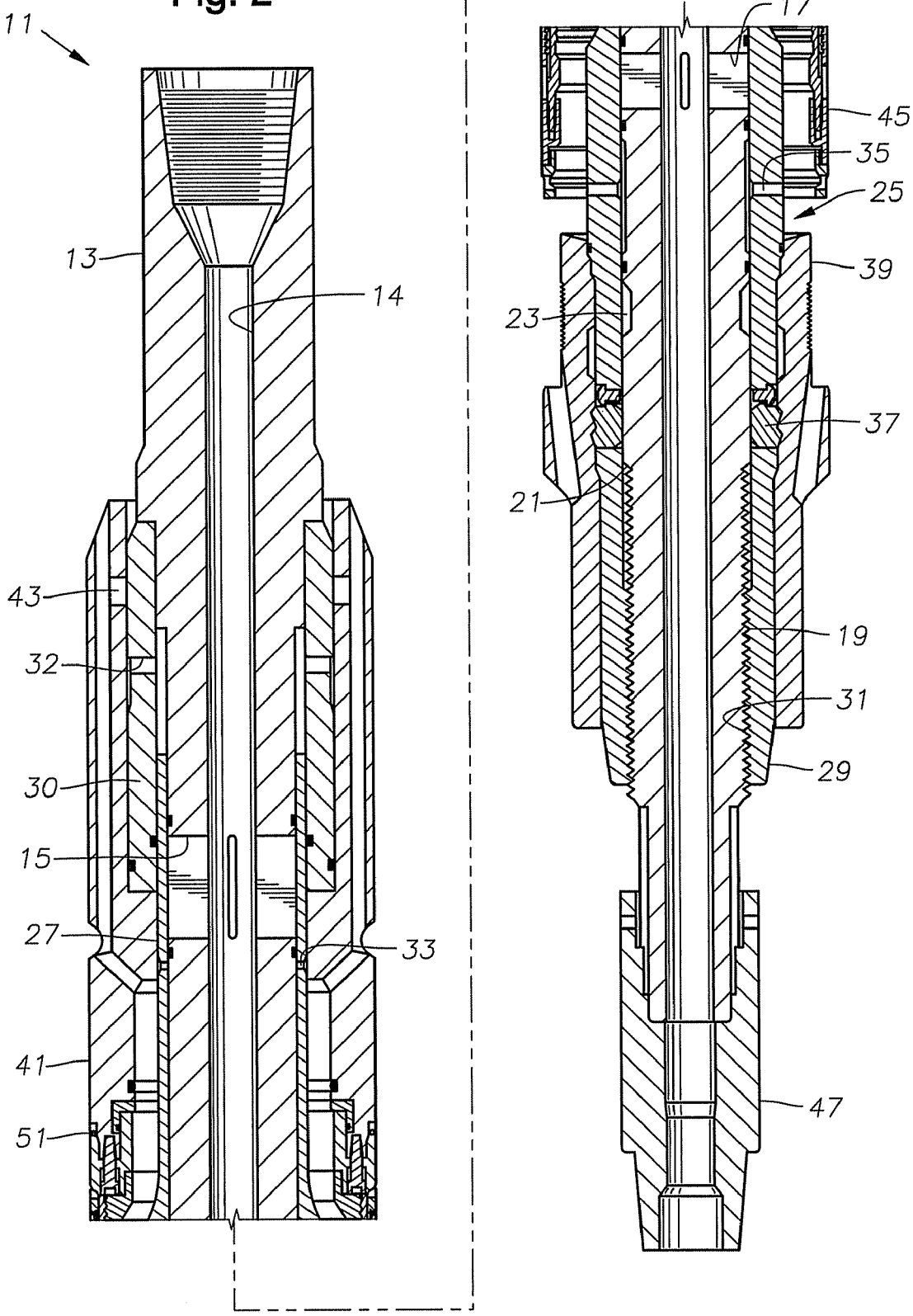
FIG. 2 is a sectional view of the high capacity running tool of FIG. 1 in the running position with the engagement element engaged.

Referring to FIG. 2, once the running tool 11 and casing hanger 39 are in abutting contact with one another, the stem 13 is rotated four revolutions. As the stem 13 is rotated relative to the body 25, the stem 13 and piston 41 move longitudinally downward relative to body 25. As the stem 13 moves longitudinally, the shoulder 21 on the outer surface of stem 13 makes contact with the engaging element 37, forcing it radially outward and in engaging contact with the inner surface of casing hanger 29, thereby locking body 25 to casing hanger 39. As stem 13 moves longitudinally, stem ports 15, 17 and body ports 33, 35 also move relative to one another.

Referring to FIG. 3, once the running tool 11 and casing hanger 39 are locked to one another, the running tool 11 and casing hanger 39 are lowered down the riser into the subsea wellhead housing (not shown) until the casing hanger 39 comes to rest. Referring to FIG. 3, a solid dart 49 is then dropped or lowered into the axial passage 14 of stem 13. The solid dart 49 lands in the landing sub 47, thereby sealing the lower end of stem 13. The stem 13 is then rotated four additional revolutions in the same direction. As the stem 13 is rotated relative to the body 25, the stem 13 and piston 41 move further longitudinally downward relative to body 25 and casing hanger 39. As the stem 13 moves longitudinally, stem ports 15, 17 and body ports 33, 35 also move relative to one another. Upper stem port 15 aligns with upper body port 33, but lower stem port 17 is still positioned above lower body port 35. This position allows fluid communication from the axial passage 14 of stem 13, through stem 13, into and through body 25, and into piston 41. Fluid pressure is applied down the drill pipe and travels through the axial passage 14 of stem 13 before passing through upper stem port 15, upper body port 33, and into chamber 42, driving piston 41 downward relative to the stem 13. As the piston 41 moves downward, the movement of piston 41 sets the packoff seal 45 between an outer portion of casing hanger 39 and the inner diameter of the subsea wellhead housing.

Figure 4:
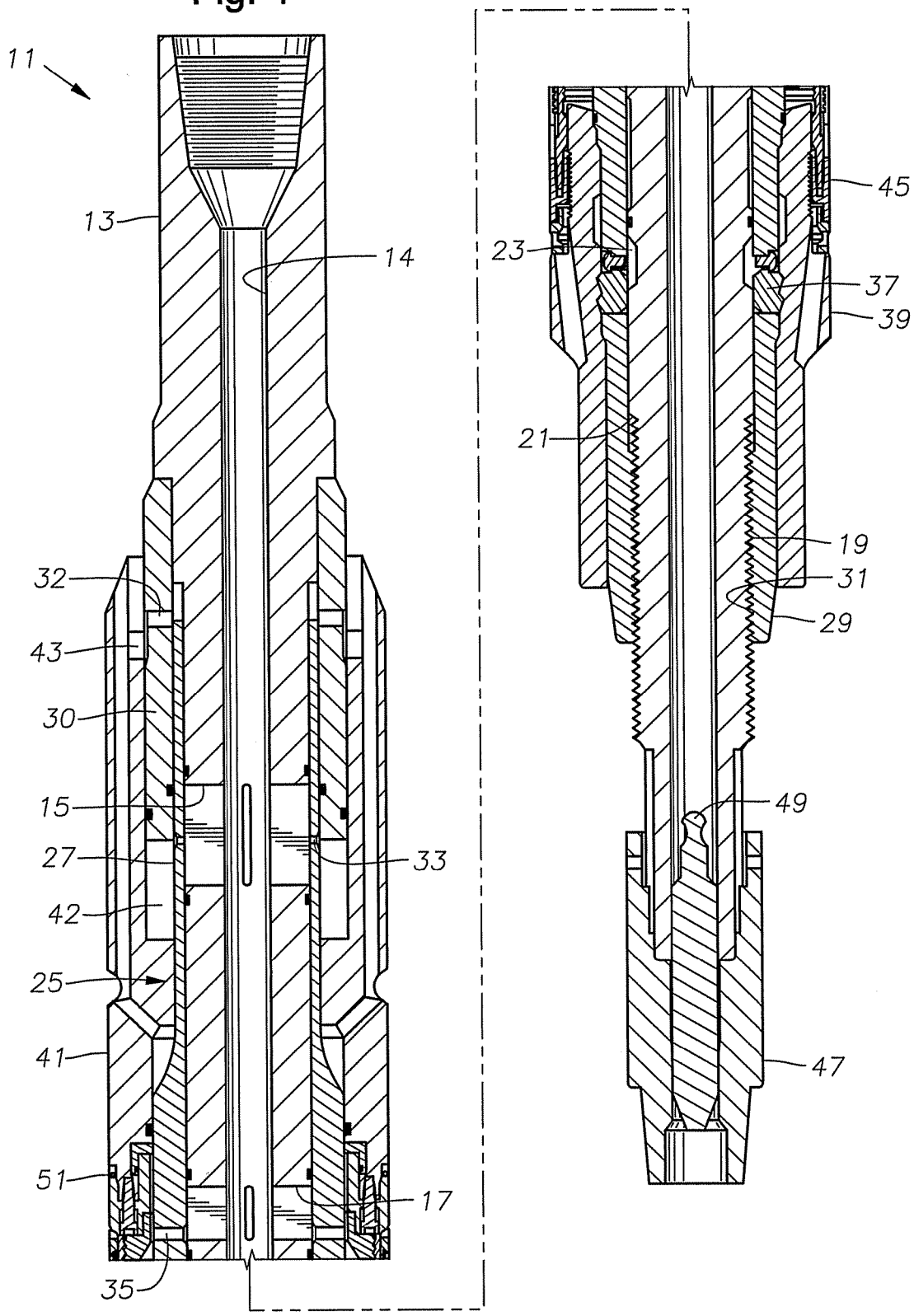
FIG. 4 is a sectional view of the high capacity running tool of FIG. 1 in the seal testing position.

Referring to FIG. 4, once the piston 41 is driven downward and packoff seal 45 is set, the stem 13 is then rotated four additional revolutions in the same direction. As the stem 13 is rotated relative to the body 25, the stem 13 moves further longitudinally downward relative to body 25 and casing hanger 39. Stem 13 also moves downward at this point relative to piston 41. As the stem 13 moves longitudinally, stem ports 15, 17 and body ports 33, 35 also move relative to one another. Lower stem port 17 aligns with lower body port 35, allowing fluid communication from the axial passage 14 of stem 13, through stem 13, into and through body 25, and into an isolated volume above packoff seal 45. Upper stem port 15 is still aligned with upper body port 33. The latch device located with the slot 32 on the outer sleeve 30 is activated by the movement of the stem 13 and will act in conjunction with piston locking ring 43 to restrict the upward movement of piston 41 beyond the latch device. Pressure is applied down the drill pipe and travels through the axial passage 14 of stem 13 before passing through lower stem port 15, lower body port 33, and into an isolated volume above packoff seal 45, thereby testing packoff seal 45. The same pressure is applied to piston 41, creating an upward force, however, movement of the piston 41 in an upward direction is restricted by the engagement of the piston locking ring 43 and the latch device (not shown) positioned in the slot 32 on outer sleeve 30. In an alternate embodiment, the size of the fluid chambers in the piston 41 and seal 45 areas could be sized such that the larger sized fluid chamber in the seal 45 area maintains a downward force on piston 41, thereby eliminating the need for the latch device and the piston locking ring 43. An elastomeric seal 51 is mounted to the exterior of piston 41 for sealing against the inner diameter of the wellhead housing. Seal 51 defines the isolated volume above packoff seal 45. If packoff seal 45 is not properly set, a drop in fluid pressure held in the drill pipe will be observed as the fluid passes through the seal area.

Figure 5:
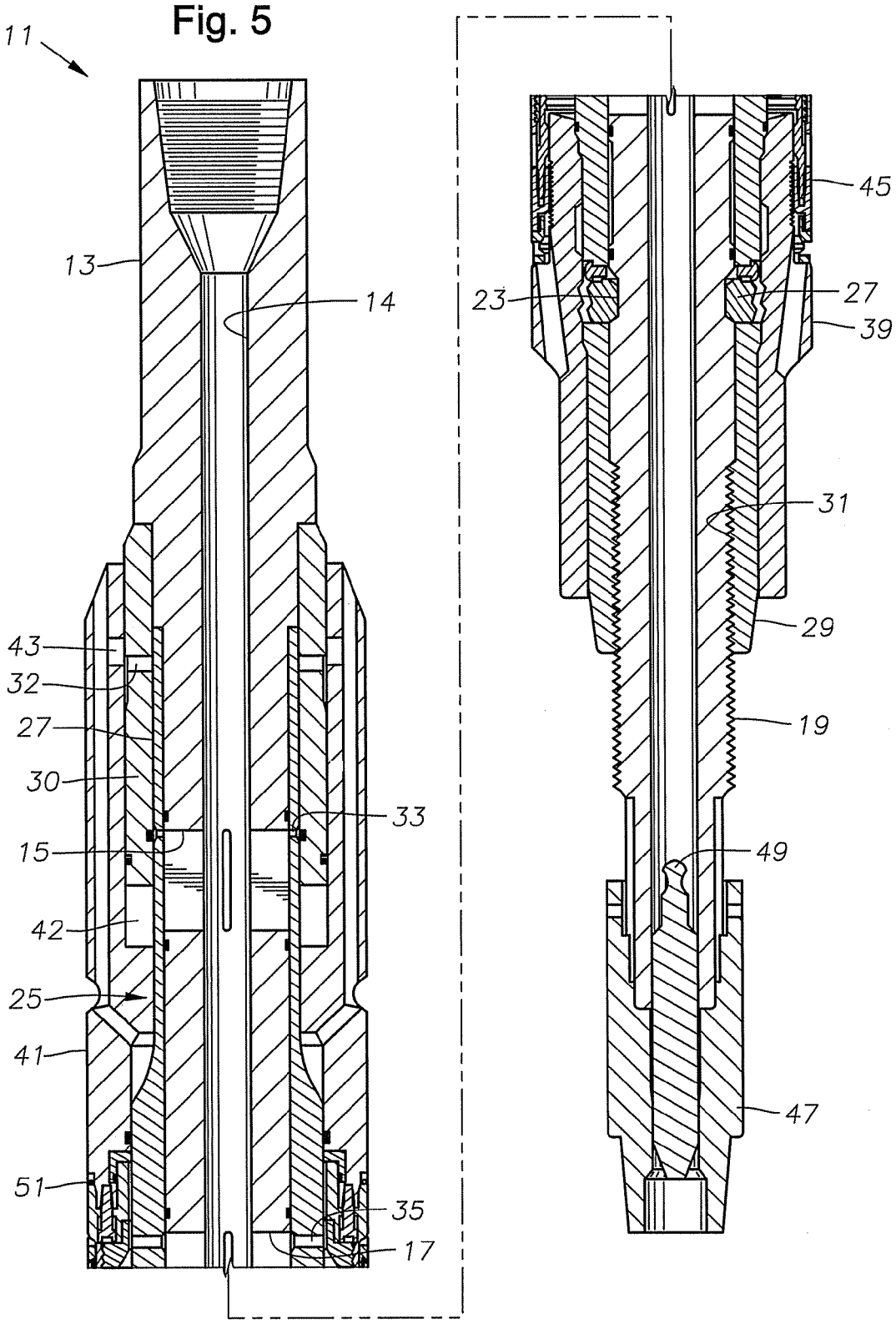
FIG. 5 is a sectional view of the high capacity running tool of FIG. 1 in the unlocked position with the engagement element disengaged.

Referring to FIG. 5, once the packoff seal 45 has been tested, the stem 13 is then rotated four additional revolutions in the same direction. As the stem 13 is rotated relative to the body 25, the stem 13 moves further longitudinally downward relative to the body 25, casing hanger 39, and piston 41. As the stem 13 moves longitudinally downward, the engagement element 37 is freed and moves radially inward into recessed pocket 23 on the outer surface of stem 13, thereby unlocking the body 25 from casing hanger 39. Upper stem port 15 remains aligned with upper body port 33. Lower stem port 17 remains aligned with lower body port 35. The lower stem port 17 and lower body port 35 vent the column of fluid in the drill pipe, allowing dry retrieval of the running tool 11. Running tool 11 can then be removed from the wellbore.

The technique has significant advantages. The elimination of a cam provides fewer leak paths and an increased hanging capacity due to the increase radial space within the running tool.

While the technique has been shown in only one of its forms, it should be apparent to those skilled in the art that it is not so limited but is susceptible to various changes without departing from the scope of the technique.

The invention claimed is:

1. A running tool for setting and internally testing a packoff of a well pipe hanger, the running tool comprising:

an elongated stem having an axial passage, threads in its outer surface, and a downward facing shoulder positioned adjacent thereto;

a body surrounding and threaded to the stem such that rotation of the stem causes the stem to translate axially relative to the body from a run-in position to a packoff set position, then to a packoff test position, and finally to a release position;

an engagement element, carried by the body and adapted to be engaged with a hanger, the axial movement of the stem relative to the body to the run-in position causing the shoulder to contact the engagement element and move it radially outward and in engagement with the hanger to releasably secure the running tool to the hanger; and a piston, substantially surrounding portions of the stem and the body and downwardly moveable relative to the stem in response to fluid pressure applied to the axial passage, while in the packoff set position to thereby set a packoff seal.

2. The running tool according to claim 1, wherein the running tool further comprises:

upper and lower stem ports located in and extending radially through the stem;

upper and lower body ports located in and extending radially through the body and adapted to align with the upper and lower stem ports at desired times; and wherein the upper stem port and upper body port when aligned while in the packoff set position actuate the piston and set the packoff, and the lower stem port and the lower body port when aligned in the packoff test position to test the packoff.

3. The running tool according to claim 2, wherein the running tool further comprises:

the upper stem port and upper body port are aligned while in the packoff test position and the lower stem port and the lower body port are not aligned while in the packoff set position.

4. The running tool according to claim 2, wherein the running tool further comprises:

a landing sub connected to a lower end portion of the stem; and a sealing object, located within the landing sub to thereby seal the lower end of the stem, enabling fluid pressure to be maintained in the axial passage in the stem while in the packoff set and packoff test positions.

5. A method of setting and testing a packoff seal of a well pipe hanger, the method comprising:

(a) providing a running tool with an elongated stem having an axial passage and threads in its outer surface; a body surrounding and threaded to the stem such that rotation of the stem causes the stem to translate axially relative to the body; and a piston, substantially surrounding portions of the stem and the body and downwardly moveable relative to the stem;

(b) rotating the stem relative to the body to a run-in position, thereby securely engaging the running tool with a hanger;

(c) running the tool and the hanger into a subsea wellhead;

(d) rotating the stem relative to the body to a set position; then (e) while in the set position, applying fluid pressure to the axial passage to cause the packoff to set and seal.

6. The method of claim 5, wherein movement from the run-in position to the set position is accomplished by rotating the stem in the same direction relative to the body.

7. The method of claim 5, wherein the stem moves axially downward relative to the body when the stem is rotated from the run-in position to the set position.

8. The method of claim 5, wherein step (b) further comprises:

providing the running tool with an engagement element carried by the body and adapted to be engaged with the hanger; and moving the stem axially relative to the body causes a shoulder to contact the engagement element and move it radially outward and in engagement with the hanger to releasably secure the running tool to the hanger.

9. The method of claim 5, wherein:

step (a) further comprises providing a running tool with an upper stem port located in and extending radially through the stem and an upper body port located in and extending radially through the body;

step (d) further comprises aligning the upper stem port and the upper body port with each other and with a piston chamber; and step (e) further comprises causing the fluid in the axial passage to flow through the upper stem port and through the upper body port into the piston chamber, thereby setting the packoff seal.

10. The method of claim 9, wherein:

step (a) further comprises providing the running tool with a lower stem port located in and extending radially through the stem and a lower body port located in and extending radially through the body; and wherein the lower stem port and the lower body port are not aligned while in the set position.

11. The method of claim 5, wherein the method further comprises after step (e):

rotating the stem relative to the body from the set position to a test position; then applying fluid to the axial passage, thereby testing the packoff seal.

12. The method of claim 11, wherein movement from the set position to the test position is accomplished by rotating the stem in the same direction relative to the body.

13. The method of claim 11, wherein the stem moves axially downward relative to the body when the stem is rotated from the set position to the test position.

14. The method of claim 11, wherein the method further comprises:

rotating the stem relative to the body from the test position to a release position, thereby releasing the running tool from the casing hanger.

15. The method of claim 14, wherein movement from the test position to the release position is accomplished by rotating the stem in the same direction relative to the body.

16. The method of claim 14, wherein the stem moves axially downward relative to the body when the stem is rotated from the test position to the release position.

17. The method of claim 11, wherein:

step (a) comprises providing the running tool with a lower stem port located in and extending radially through the stem and a lower body port located in and extending radially through the body;

after step (c), rotating the stem relative to the body, thereby aligning the lower stem port and the lower body port; and applying fluid to the axial passage, thereby causing the fluid to flow through the lower stem port and through the lower body port, thereby testing the packoff seal.

18. The method of claim 17, wherein:

step (a) further comprises providing a running tool with an upper stem port located in and extending radially through the stem and an upper body port located in and extending radially through the body; and wherein the upper body port and the upper stem port are aligned while in the seal test position.

19. A method of setting and testing a casing hanger seal, the method comprising:

(a) providing a high capacity running tool with an elongated stem having an axial passage, upper and lower stem ports located in and extending radially therethrough, threads in its outer surface and an shoulder positioned adjacent thereto; a body with upper and lower body ports located in and extending radially therethrough, the body surrounding and threaded to the stem such that rotation of the stem causes it to translate axially relative to the body; a piston, substantially surrounding portions of the stem and the body and downwardly moveable relative to the stem; an engagement element carried by the body and adapted to be engaged with a casing hanger;

(b) rotating the stem relative to the body to a run-in position, thereby moving the stem downward and causing the shoulder to contact the engagement element and move it radially outward and in engagement with the casing hanger to releasably secure the running tool to the casing hanger;

(c) rotating the stem relative to the body in the same direction to a packoff set position, thereby aligning the upper stem port and the upper body port;

(d) applying fluid pressure to the axial passage, thereby causing the fluid pressure to flow through the upper stem port and through the upper body port, thereby setting the packoff seal;

(e) rotating the stem relative to the body in the same direction to a packoff test position, thereby aligning the lower stem port and the lower body port; and (f) applying fluid to the axial passage, thereby causing the fluid to flow through the lower stem port and through the lower body port, thereby testing the packoff seal.

20. The method of claim 19, further comprising after step (f):

rotating the stem relative to the body in the same direction to a release position, thereby moving the stem downward and causing the shoulder to cease contact with the engagement element, thereby freeing the engagement element to move radially inward, releasing the running tool from the casing hanger.

* * * * *